United States Patent [19]

Joergensen

[11] Patent Number: 4,779,873

[45] Date of Patent: Oct. 25, 1988

[54] ELECTRICAL GAME APPARATUS

[76] Inventor: Kolbein O. Joergensen, Playtronic Portuguesa, Ltd., Rua Antonio Nobre 3-8 Esq., 2800 Almada, Portugal

[21] Appl. No.: 925,784

[22] Filed: Oct. 31, 1986

[51] Int. Cl.[4] ..... A63F 3/00

[52] U.S. Cl. ..... 273/237; 273/1 E

[58] Field of Search ..... 273/237, 269, 273, 274, 273/1 E

[56] References Cited

U.S. PATENT DOCUMENTS

| | | | |
|---|---|---|---|
| 1,407,223 | 2/1922 | Rose | 273/274 |
| 2,727,746 | 12/1955 | Hawkes | 273/246 |
| 2,844,374 | 7/1958 | French | 273/237 |
| 3,345,069 | 10/1967 | Kuziak | 273/1 E |

FOREIGN PATENT DOCUMENTS

| | | | |
|---|---|---|---|
| 438290 | 5/1912 | France | 273/274 |
| 557628 | 6/1957 | France | 273/237 |

OTHER PUBLICATIONS

"Number-Guessing Game", Popular Mechanics, pp. 134, 135, 136, 190, Jan. 1973.

*Primary Examiner*—Richard C. Pinkham
*Assistant Examiner*—Benjamin Layno
*Attorney, Agent, or Firm*—Alfred E. Miller

[57] ABSTRACT

A game apparatus includes a playing board having a plurality of positions, each position having a plurality of numerically identified regions. Each position also selectively controls the energization of selected lights associated with the position. Each player position also has a plurality of chips adapted to be received on the numerically identified regions of the board.

8 Claims, 4 Drawing Sheets

ELECTRICAL GAME APPARATUS

This invention relates to a game apparatus and system, and is especially directed to the provision of a game apparatus and system for use by a plurality of players, and incorporating a game board and a plurality of chips or tokens.

Briefly stated, in accordance with the invention, a game board is provided having a plurality of player positions, for example four positions. Each of these positions has associated therewith a determined number of lamps, and a separate switch for operating each of the lamps, thereby enabling each player to select the energization of a given number or group of respective lamps. In addition, the board has a plurality of marked locations, at each player's position, for the placement of chips or the like. These marked locations may include a series of numerically marked locations corresponding to the number of possible lamps that may be lit by the players in the game, as well as locations having indicia indicating the various combinations of lamps that may be lit at each player's position.

An example of the subject matter of the present invention is set forth in my prior application Ser. No. 534,407 filed Sept. 21, 1983, an now abandoned. However, this invention is an improvement thereover.

The game apparatus and set further includes a plurality of chips, tokens or the like, which the players may selectively position at the various marked locations on the board, depending upon the manner in which the apparatus is employed.

In order that the invention will be more clearly understood, it will now be disclosed in greater detail with reference to the accompanying drawings, wherein.

Figure 1:
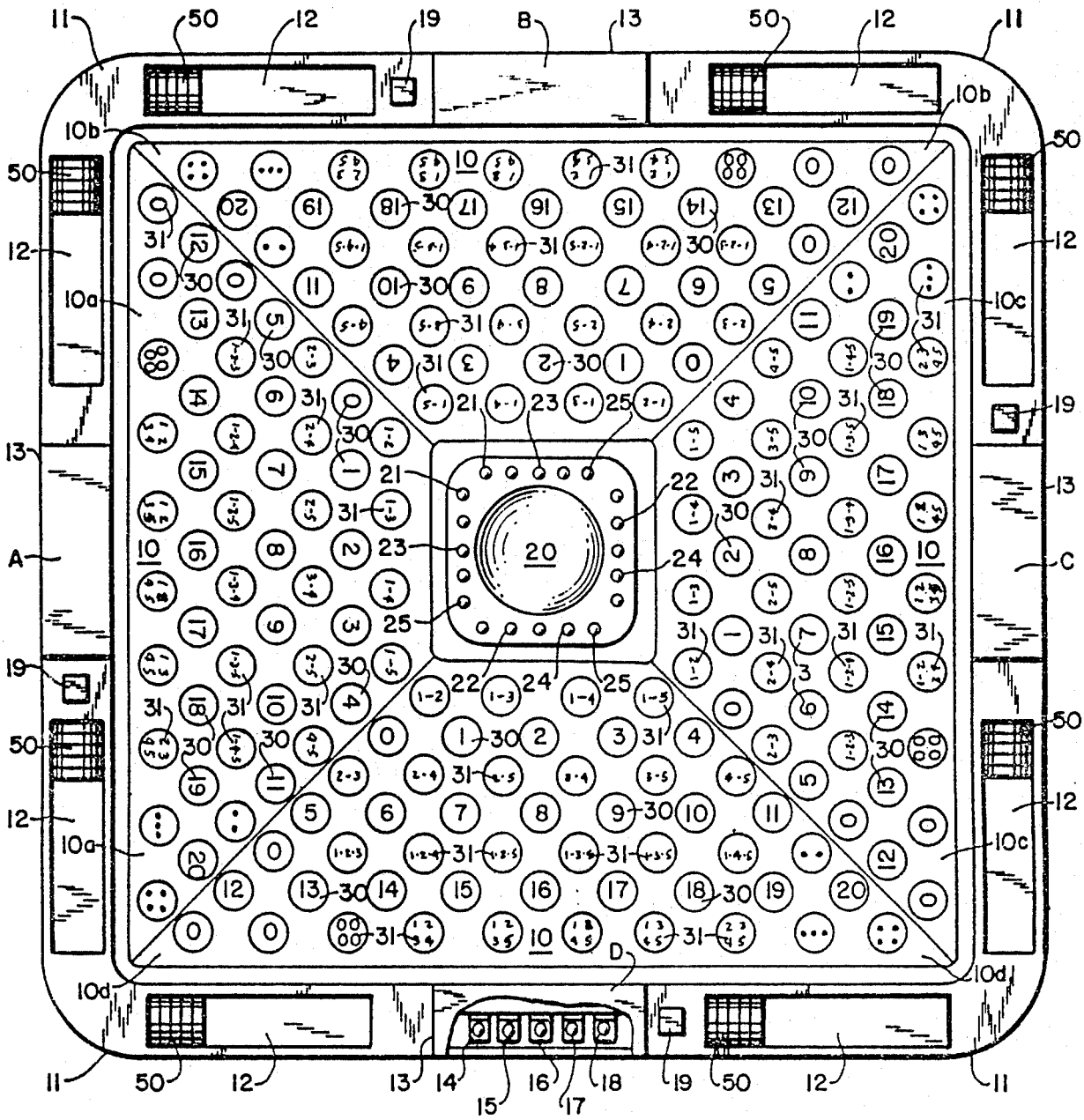
FIG. 1 is a top view of the preferred embodiment of a game board in accordance with the invention.
Figure 2:
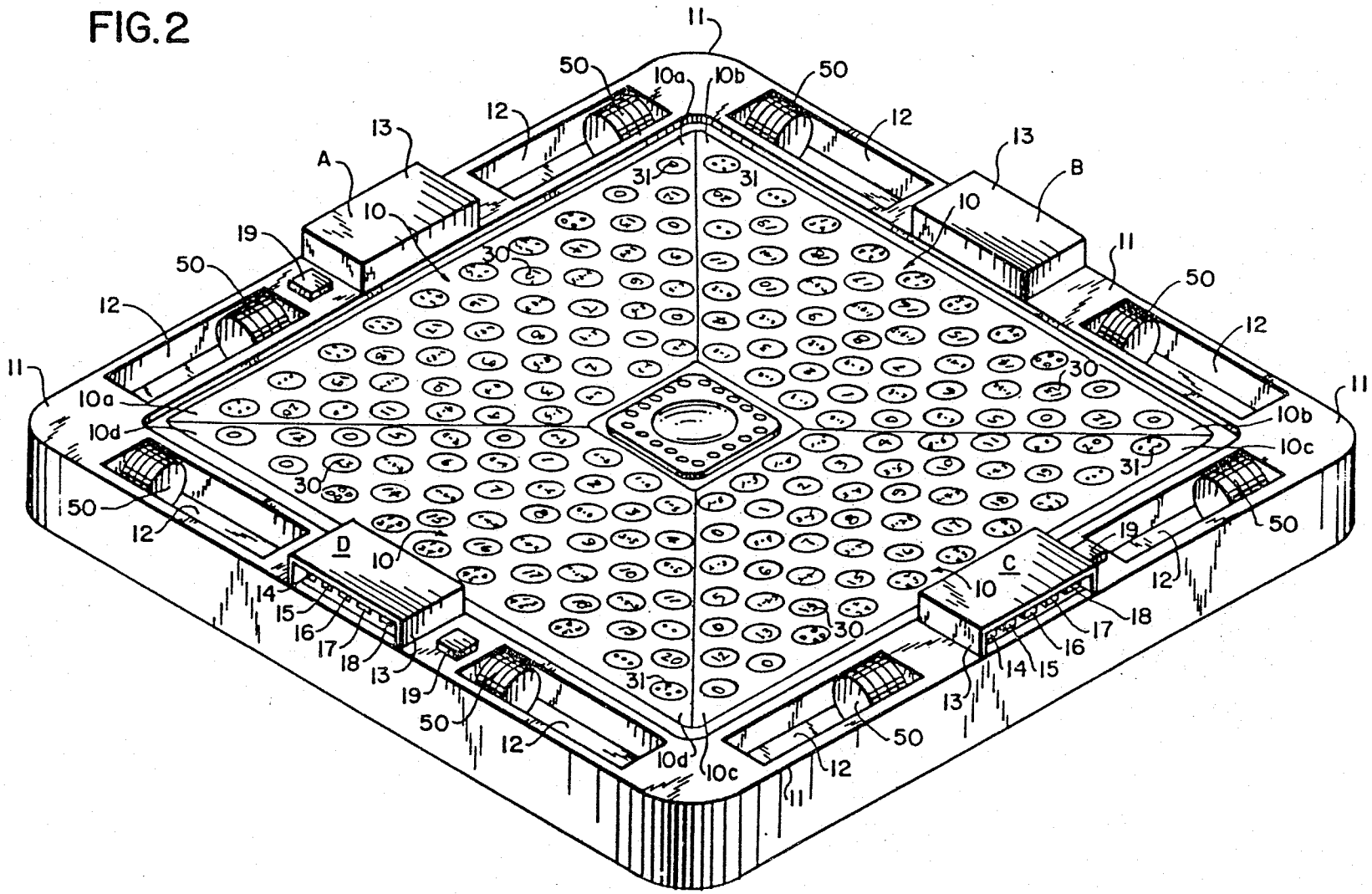
FIG. 2 is a perspective view of the board of FIG. 1.

Referring now to the drawings, and more in particular to FIGS. 1 and 2, the game board has a playing surface 10 visually separated into regions corresponding to a plurality of separate player positions. In the illustrated example, the board has four player positions A, B, C, D, the board therefore being generally square with the portions 10A, 10B, 10C and 10D of the board corresponding to the different players being generally triangular with their apices at the center of the board. The playing area of the board is preferably flat, and may be of any conventional playing board material. The board is preferably provided with an outside frame 11 having recesses 12 at each player position for the storage of playing chips or tokens. In addition, a switch cover 13 is provided at each player position for the storage of playing chips or tokens. In addition, a switch cover 13 is provided at each player position, for concealing the positions of switches thereunder, such as the switches 14, 15, 16, 17 and 18 thereunder as seen in FIG. 2. The switches 14–18, which may for example be slide switches or toggle switches, are bistable switches, preferably single pole, single throw switches. The switches 14–18 are arranged so that each player may control the positions of the switches without any other players being able to see the selected positions. It is, of course, apparent that other switch arrangements may be employed to serve this function.

In addition, a further switch 19 is also provided at each player position. The switches 19 may be exposed to view by all players, if desired, and these switches are preferably momentary contact single pole, single throw switches.

As further seen in FIGS. 1 and 2, a recess or cup 20 is conveniently provided at the center of the board, for receiving chips in accordance with various modes of play. The recess or cup 20 conveniently provides a mounting for lamps 21, 22, 23, 24 and 25 associated with each of the player positions. Thus, as illustrated, the cup 20 may be generally square, with the lamps 21–25 associated with each player position being on the side of the cup 20 toward the respective player position. The interconnection of the lamps and the switches will be more clearly described with reference to FIG. 3.

Each portion 10A–10D of the board is further provided with a plurality of locations for the reception of chips or tokens i.e., so that chips may be distinctively placed or stacked thereon. In the illustrated embodiment of the invention these marked locations are circular, although it will be apparent that other configurations may be employed, as desired. Of these locations, a first group 30 is numerically sequentially marked in each of the player's regions, the sequence of numbers extending thorough the range of total number of lights that may be energized on the board, i.e., the number of lights 21–25 at each player position times the number of player positions. In the illustrated example, this range may extend from zero, with no lamps lit, to 20, with all lamps lit.

Another group 31 of marked locations corresponding to each player position is numerically or otherwise marked to indicate the various groups of lamps that may be lit at each player position. For example, the marking 1-2 represents the lighting of the first two lamps at the respective player's position, and the marking 1-4-5 corresponds to the lighting of the 1st, 4th and 5th lamps at the respective position. In order to include in this series of indications the possibility of only one lamp, or no lamps being included at each player position, the markings of the numerical series of locations 30 may be employed for this purpose. Further ones of the lamps 31 may have one or more zeros to represent the absence of lamps lit at one or more player positions, or dots to represent other conditions such as coincidence of player selections, etc.

The locations 30 and 31 may be arranged on the board in any convenient manner, and hence need not follow the illustrated arrangement.

Figure 3:
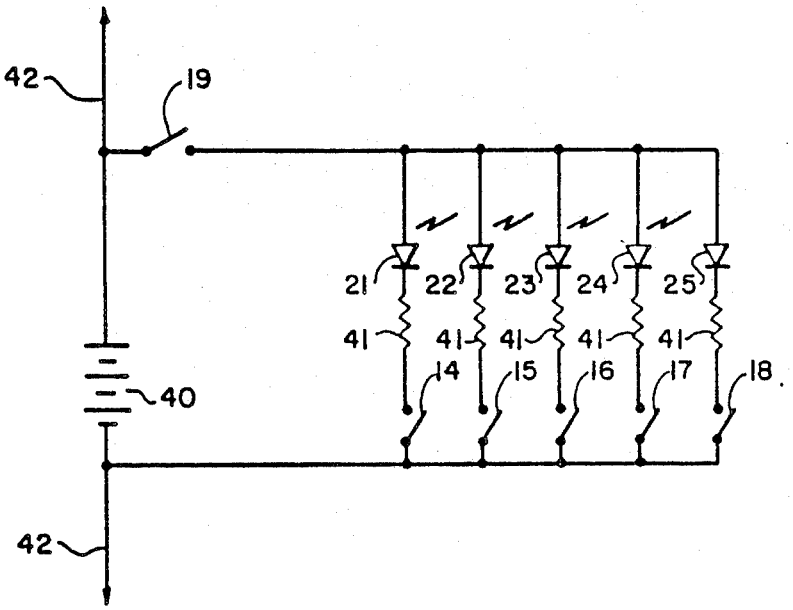
FIG. 3 is a circular diagram of the lamp operating circuits for one player's position.

Referring now to FIG. 3, in a preferred embodiment of the invention the bistable switches 14–18 are serially connected to the lamps 21–25 are respectively, these series interconnections being connected in parallel. The parallel circuit thus formed is connected to a battery 40 by way of the momentary switch 19. The lamps 21–25 are preferably LED's, as illustrated. Series resistors 41 may be provided for the LED's, to limit current. The battery 40 may be, for example, a conventional 9 volt battery.

It is apparent from the circuit of FIG. 3 that the individual lamps 21–25 may be enabled by the closure of selected ones of the switches 14–18, without the lamps being lit. Then, at a determined time in the game, the switch 19 may be closed to effect the energization of all of the selected lamps.

The circuit illustrated in FIG. 3 corresponds to only one player position, and hence identical circuits are provided for each of the player positions, the battery 40 of course may be common to the other circuits as well, and interconnected thereto by way of the leads 42.

In addition to the game board, such as illustrated in FIGS. 1 and 2, the game apparatus in accordance with the invention also includes a plurality of chips, tokens, counters or the like, such as the chips 50 illustrated in FIG. 1, so that each player may be provided with a plurality of such pieces. The chips or the like are preferably of different colors, so that the different players may initially be issued distinctive chips.

The game apparatus and system in accordance with the invention may be employed in the playing of several different types of games, as follows:

GAME NO. 1

In this game, each player is issued the same number of chips. At the start of play, each player places a determined number of chips in the center cup 20. Then, each player secretly controls the switches 14–18 at the respective player position, to enable a determined number of the respective lamps to be lit, by the closure of the respective switches 14–18 (or to leave all of the switches open). After each player has thus made a secret selection of the number of lamps to be lit at the respective player position, the players sequentially guess the total number of lamps that have been selected by all players, and place a chip on the corresponding marked number location 30 of the respective player's position. After each player has made such a guess, and placed a chip on one of the marked locations 30, the players then simultaneously operate their momentary switches 19, so that all of the selected lamps of all of the players will be lit.

The total number of lamps that have been so lit is then counted, and if any player has placed his chip on the corresponding marked number location 30, that player wins all of the chips on the board and in the cup member. If two or more players have made the correct guess, then the chips on the board and in the cup are equally divided amongst the winners. If none of the players has placed a chip on the correct marked number location, the chips on the board are placed in the cup, or "pot", and the play continues with each player selecting a new number of lamps by the respective switches 21–25, and guessing the total number of lamps that will be lit, placing a chip on such number of the respective marked number location 30. The play thus continues until the first player correctly guesses a number, such player winning all of the chips in the "pot", as well as on the board.

If one of the players goes "broke", i.e., loses all of his chips, he can either retire from the game, or purchase more chips (for example purchasing his own chips back from another player), for a price agreed before the start of play.

Figure 4:
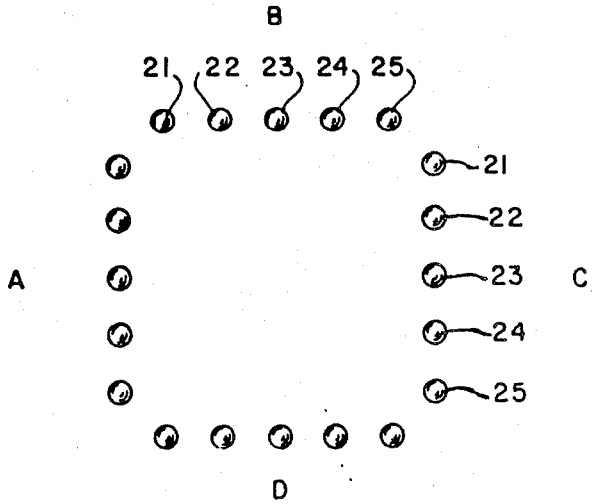
FIG. 4 is a schematic illustration of a portion of the game board, illustrating one game that may be played thereon.
Figure 4:
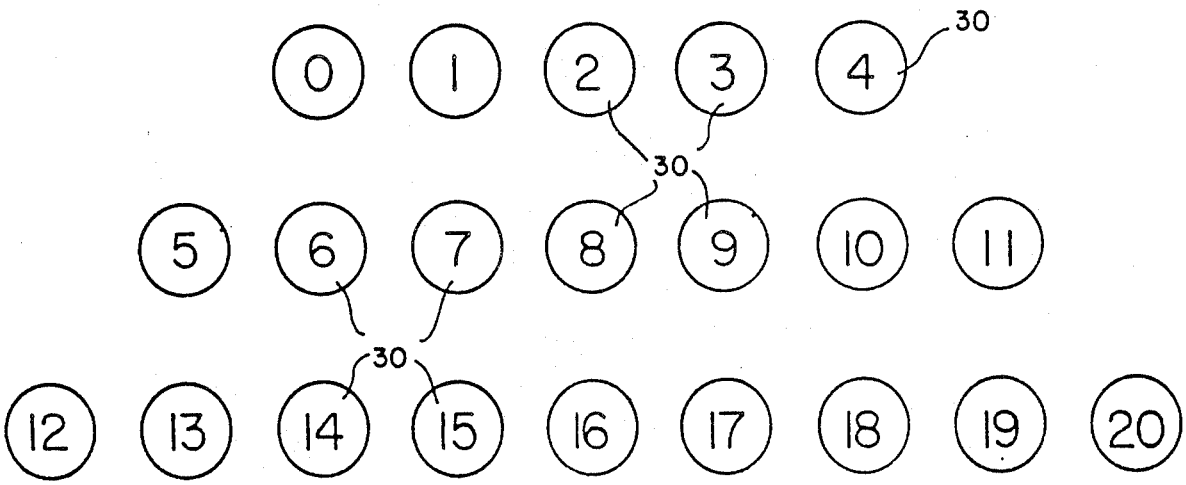

This game is illustrated in FIG. 4, wherein, after the depression of the momentary switches 19 (FIG. 3), it is seen that player A has chosen to light five lights, player B has chosen to light one light, player C has chosen to light no light, and player D has chosen to light three lights. Consequently, a total number of nine lights has been lit on the board. If player D had placed his chip on the marked number location 30 corresponding to the number 9, then this player would have won all of the chips in the "pot" and on the board (unless it was necessary to share them with other winners). If the player D had placed a chip on any of the other numbers, then this chip will be placed in the "pot" for the next round of play, unless another player had won it.

GAME NO. 2

In this game, all of the players are initially issued the same number of chips, as in the previous game.

In the first step of play, each player secretly operates the respective switches 14–18, to close a group of these switches, thereby selecting a "code". Thus, the closing of switches 14 and 15 correspond to a different code than the closing of switches 14 and 18. The players then sequentially try to guess the "code" that has been selected by all of the other players. For this purpose, each player places a chip on one or more of the marked number location 31 of the other players' positions. The game rules may permit, for example, up to three such chips on the portion of the board corresponding to each of the other players. Following the placement of chips by all of the players, the players then depress their momentary switches 19 to display the respective codes. If any players' chips had been positioned at the marked number location 31 that correctly represents the code of lights lit as respect to that other players' position, then that player wins all of the chips on the board and in the "pot". If more than one player so correctly guesses a code of another player, then the chips on the board and in the "pot" are equally split. If no player has won in this manner, the chips on the board are placed in the "pot", and the play continues with each of the players again selecting a secret code and guessing the codes of the other players.

Figure 5:
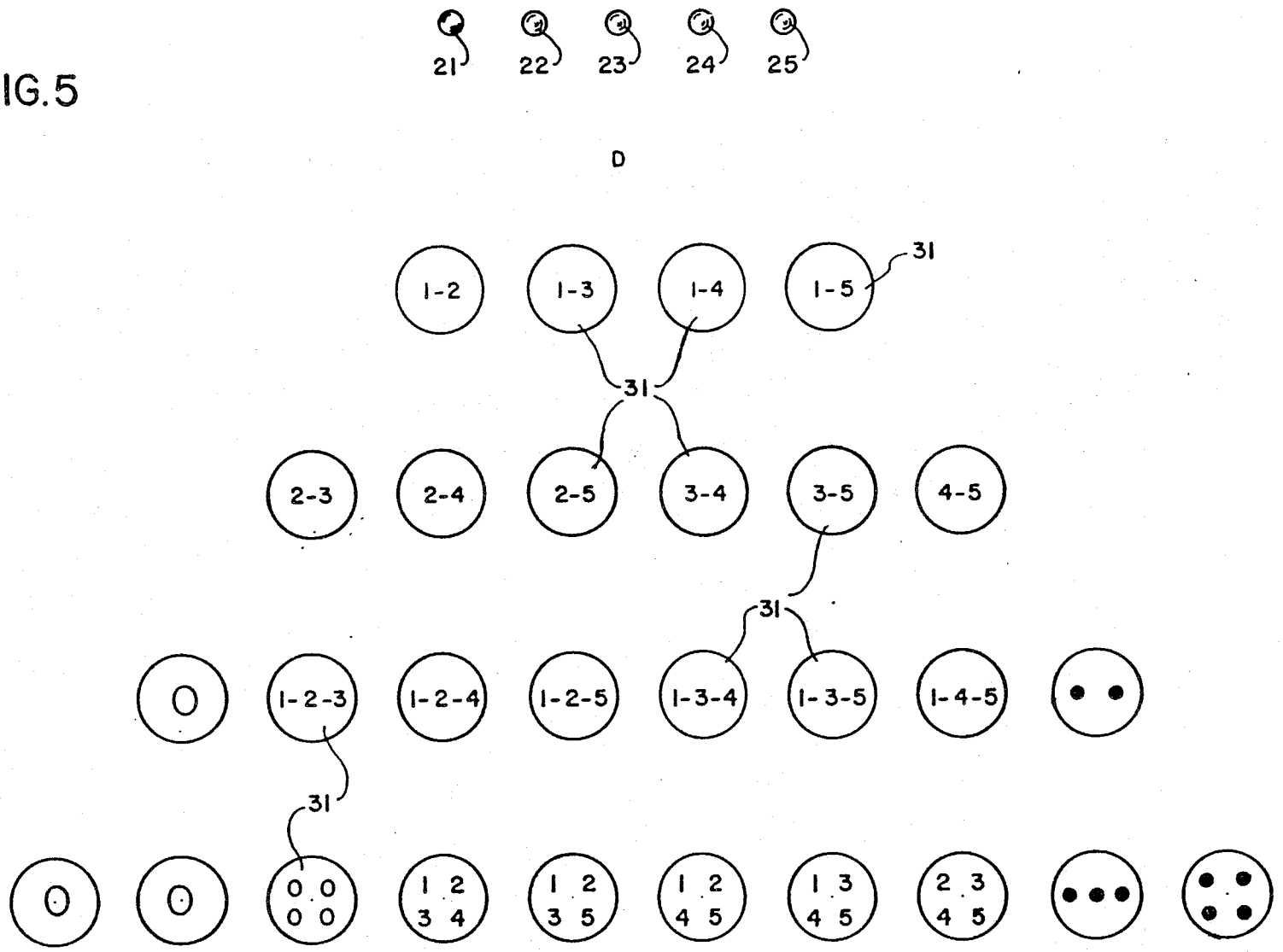
FIG. 5 is a schematic illustration of a portion of the game board, and illustrating another game that may be played thereon.

As an example, as illustrated in FIG. 5, the player D has closed the respective switches corresponding to lamps 21, 23 and 24, thus corresponding to the code 1-3-4. If any other player had placed a chip on the marked number location 31 corresponding to the code 1-3-4, at the board position of player D, then such other player would have won all of the chips on the board, including the chips at the other player positions, as well as all chips in the "pot".

In order to simplify the calculation of winners, it is of course desirable for each player to be provided with chips of a distinctive color.

In Game No. 2, as well as in Game No. 1, it is preferred that each player be initially provided with 50 chips. It will of course be apparent that the term "chips", as employed herein, refers to any form of object or device that may be placed at a position on the game board.

The regions of the playing board that have markings not described above are optional, and may serve decoration purposes, if desired.

While the invention has been disclosed and described with reference to a single embodiment, it is apparent that variations and modifications may be made therein, and it is therefore intended in the following claims to cover each such variation and modification as falls within the true spirit and scope of the invention.

What is claimed is:

1. A game apparatus comprising a playing board having a plurality of player positions, an electric circuit including N lamps corresponding to each player position and N switches at each player position for selectively energizing the respective N lamps, wherein N is an integer, each player position of the board further including a plurality of first regions separately sequentially numbered from 0 to N×M for the selective receipt of chips, wherein M is the number of said player positions, and a plurality of second regions separately numerically marked to correspond to all of the combinations of lamps of the respective player position that are not represented by said first regions.

2. The game apparatus of claim 1 wherein each player position further includes an additional switch having an off position inhibiting the lighting of the lamps of the respective player's position and an on position at which the lamps corresponding to the respective closed N switches are lit.

3. The game apparatus of claim 1 wherein said board is generally rectangular and has four substantially triangular player positions defined generally by the edges of the rectangle and extending to the center of the board, and further comprising cup means at the center of said board for receiving chips, said lamps being positioned adjacent said cup means.

4. The game apparatus of claim 1 further comprising a plurality of chips adapted to be selectively positioned on said first and second regions.

5. A game apparatus comprising a generally square playing board, said board defining four generally triangular player positions, each player position including a separate side of the game board and extending generally to the center thereof, said game board having N lamps and N first switches in each player position, wherein N is an integer, each of said first switches at each player position being connected to enable a separate one of said lamps at the respective player positions to be energized upon operation of a respective second switch, each player position comprising a second switch connected to energize the lights of the respective players' position that have been enabled by the first mentioned switches thereof, the board at each of said player positions further having a plurality of first regions separately sequentially numbered from 0 to 4×N for the selective receipt of chips, wherein M is the number of said player positions, and a plurality of second regions for the receipt of chips and separately marked to identify all of the combinations of lamps of the respective player position that is not represented by said first positions.

6. The game apparatus of claim 5 wherein said N first switches are bistable switches and said second switches are momentary switches.

7. The game apparatus of claim 5 wherein said board has a border, said N first switches and second switches being mounted in said border, and further comprising shield means for inhibiting viewing of the N first switches of each position from the others of said positions.

8. The game apparatus of claim 7 wherein said board further comprises a cup at the center thereof for receiving chips.

* * * * *